US007933427B2

(12) United States Patent
Gelbart et al.

(10) Patent No.: US 7,933,427 B2
(45) Date of Patent: Apr. 26, 2011

(54) METHOD AND SYSTEM FOR EQUAL ACOUSTICS PORTING

(75) Inventors: Shlomo Gelbart, Modi'in (IL); Deborah A. Gruenhagen, Southwest Ranches, FL (US); Karl F. Mueller, Sunrise, FL (US)

(73) Assignee: Motorola Solutions, Inc., Schaumburg, IL (US)

( * ) Notice: Subject to any disclaimer, the term of this patent is extended or adjusted under 35 U.S.C. 154(b) by 1337 days.

(21) Appl. No.: 11/426,780

(22) Filed: Jun. 27, 2006

(65) Prior Publication Data

US 2007/0297629 A1 Dec. 27, 2007

(51) Int. Cl.
*H04R 25/00* (2006.01)

(52) U.S. Cl. ..... 381/333; 381/306; 381/388

(58) Field of Classification Search ..... 381/306, 381/333, 334, 150, 381–382, 388; 455/569.1, 455/575.1, 565
See application file for complete search history.

(56) References Cited

U.S. PATENT DOCUMENTS

2006/0128440 A1 6/2006 Murray et al.

FOREIGN PATENT DOCUMENTS

WO 2008002694 A2 1/2008
WO 2008002694 A3 1/2008

OTHER PUBLICATIONS

PCT International Preliminary Report Application No. PCT/US2007/064631 dated Jan. 15, 2009—8 pages.
PCT International Search Report Application No. PCT/US2007/064631 dated Feb. 14, 2008—8 pages.
Australian Patent Office—Office Action dated Feb. 2, 2010—1 page.

*Primary Examiner* — Suhan Ni
(74) *Attorney, Agent, or Firm* — Barbara R. Doutre

(57) ABSTRACT

A device (300) and method (600) for equal audio porting is provided. The device can include a first side with at least one first audio port (182) providing a data communication aspect, a second side with at least one second audio port (184) providing an audio communication aspect, and a transducer (110) positioned between the first side and the second side. The transducer projects sound out of the at least one first audio port and the at least one second audio port such that a quality of the sound through the at least one first audio port and the at least one second audio port are substantially the same.

12 Claims, 5 Drawing Sheets

900

950

METHOD AND SYSTEM FOR EQUAL ACOUSTICS PORTING

FIELD OF THE INVENTION

This invention relates generally to a transducer arrangement design, and more particularly to a transducer audio porting to channel audio.

BACKGROUND OF THE INVENTION

The hand-held radio industry is constantly challenged in the market place for high audio quality, low-cost products. Certain traditional markets, such as the fleet service workforce, have created an increased demand for high audio radios having speakerphone capabilities. The high audio speakerphones allow a user to engage in a voice conversation without having to hold the radio to the ear. The high audio speakerphones also allow users to engage in data communication services such as text messaging. Further, with the demand to make products smaller and with more features, speakerphone designs have started to include the high-audio speaker (transducer) within the mechanical housing of the radio to decrease product size. For example, in one arrangement, the transducer can be positioned behind the keys to project audio (port) around the keypad or through the keypad. Porting refers to channeling acoustic sound waves produced by the transducer.

Many radios also have displays for presenting digital images or video. The displays are typically low current devices, and are therefore suitable for use in portable battery-powered phones. A user typing at the keypad of the phone can simultaneously visualize text or images on the display, and listen to sound during speakerphone mode. The keypad and display arrangement allow a user to perform tasks such as text messaging while listening to audio. This allows the radio to be used in a data communications mode in addition to a traditional mode, such as hand-held person-to-person audio communication.

The orientation of the radio, when used for data communication or audio communication, can have a noticeable impact on subjective audio quality. That is, the perception of sound can vary based on the way the user holds the radio in data or audio communication mode. A need therefore exists for designing an audio porting arrangement that is suitable for both modes of usage.

SUMMARY OF THE INVENTION

Embodiments of the invention are directed to an equal audio port device. The device can include a first side with at least one first audio port providing a data communication aspect, a second side with at least one second audio port providing an audio communication aspect, and at least one transducer positioned between the first side and the second side. The at least one transducer projects sound out of the at least one first audio port and the at least one second audio port such that a quality of the sound through the at least one first audio port and the at least one second audio port are substantially the same.

DETAILED DESCRIPTION OF THE DRAWINGS

Figure 1:
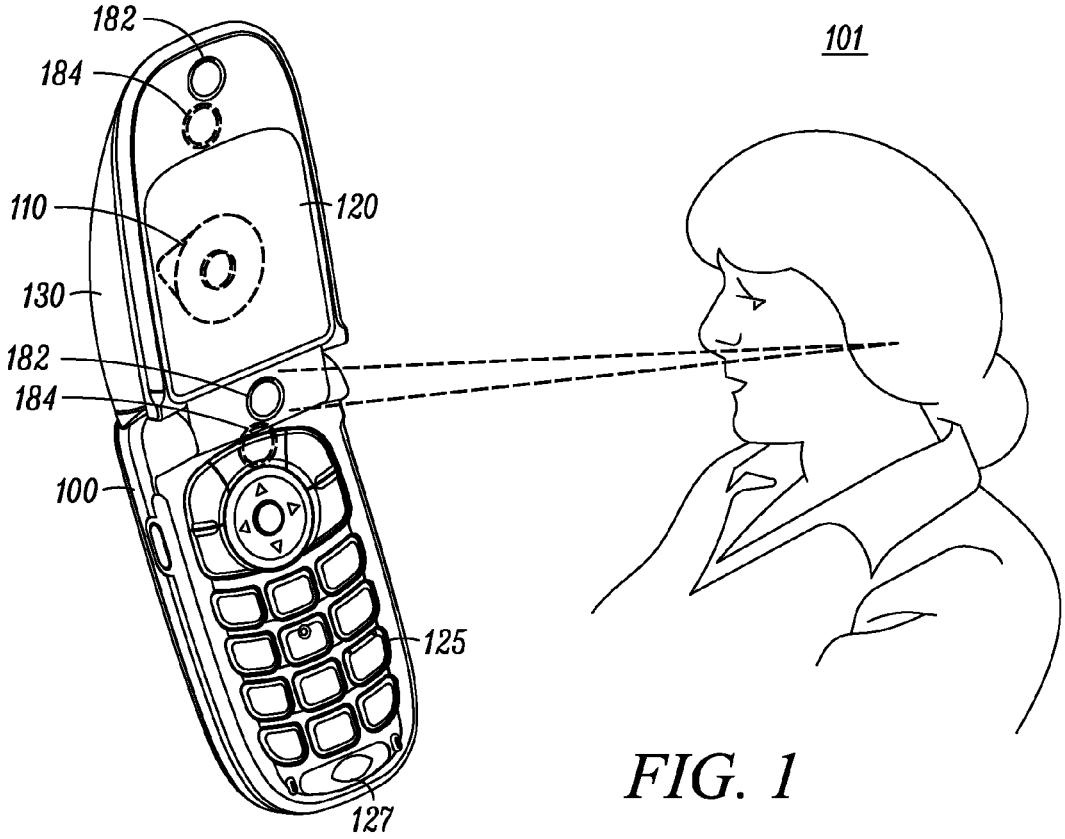
FIG. 1 is a front aspect of an audio device providing equal porting in accordance with an embodiment of the present invention.

While the specification concludes with claims defining the features of the embodiments of the invention that are regarded as novel, it is believed that the method, system, and other embodiments will be better understood from a consideration of the following description in conjunction with the drawing figures, in which like reference numerals are carried forward.

As required, detailed embodiments of the present method and system are disclosed herein. However, it is to be understood that the disclosed embodiments are merely exemplary, which can be embodied in various forms. Therefore, specific structural and functional details disclosed herein are not to be interpreted as limiting, but merely as a basis for the claims and as a representative basis for teaching one skilled in the art to variously employ the embodiments of the present invention in virtually any appropriately detailed structure. Further, the terms and phrases used herein are not intended to be limiting but rather to provide an understandable description of the embodiment herein.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "volume area" is used to describe a volumetric region, and the term "volume level" is used to describe a sound pressure level.

Embodiments of the invention are directed to an audio porting scheme wherein audio can be ported to at least two sides of a radio. The audio porting scheme can provide equal acoustic porting to the sides of a radio. Equal acoustic porting refers to an arrangement wherein a transducer projects sound in at least two directions and the sound quality in the at least two directions is substantially the same. In particular, the sound quality in a first direction is substantially similar to a sound quality in a second direction. For example, a data communications aspect may be on a first side of a radio and an audio communications aspect may be on a second side of the radio. From the user's perspective, the sound quality generated by the radio sounds the same if the radio is oriented for a data communication aspect or oriented for an audio communications aspect. The sound quality can be measured and adjusted to achieve equal audio porting based on a spectral distortion measure or a loudness rating.

In a first arrangement, the radio can have one or more audio ports positioned at one or more sides of the radio. A sound quality at a first audio port and a second audio port will be perceptually the same regardless of which side of the radio is facing the user. For example, a front side of the radio can be used for data communication, which can include a keypad and a display. A back side of the radio can be used for audio communications. A transducer can be positioned between the front side and the back side for projecting sound out of a front audio port and a back audio port. When the user holds the radio in audio communication mode, the front side faces the user. When the user holds the radio in data communication mode, the back side faces the user. The sound emanating from the device in either mode can have the same subjective sound quality. For example, the same spectral shaping can be imparted to the sound in either mode. As another example, the loudness of the sound can be the same in either data communication mode or audio communication mode.

In a second arrangement, the radio can have one or more audio ports positioned to the left of the radio and to the right of the radio. A sound quality at a first audio port on the left side and a sound quality at a second audio port on the right side will be perceptually the same regardless of which side of the radio is facing the user. When the user holds the radio in audio communication mode, the front side faces the user. When the user holds the radio in data communication mode, the back side faces the user. The sound emanating from the device at the first audio port on the left side and the second audio port at the right side in either holding mode can have the same subjective sound quality. The left and right porting arrangements are suitable when the radio is in a belt-clip, a carry holster, or similar side carrying position. In these usage situations the front or the back of the device is obscured. In a left and right equal porting arrangement, sound can emanate in a direction that is not obscured.

Sound can be channeled between the first side and the second side through one or more audio channels. The first audio port can have a first audio channel and the second audio port can have a second audio channel. The first audio channel and the second audio channel can be symmetrical with respect to mechanical design. In another configuration, the overall volume area or length of the audio channels for the first audio port and the second audio port can be matched to produce equal ported audio. A porting arrangement can be designed such that a sound wave produced from the transducer when passing through the first audio channel and the second audio channel results in the same subjective quality at the first audio port and the second audio port. In yet another arrangement, a non-symmetrical design can be provided to provide equal volume area porting for the first audio channel and the second audio channel.

Referring to FIG. 1, a radio 100 having an equal audio port configuration is shown. The radio 100 can be used in a frontal arrangement 101 wherein a front of the radio is presented to a user as shown. The equal audio port configuration can include a transducer 110 and a mechanical housing 130 that provides a front audio port 182 and a back audio port 184. The transducer 110 can be a high audio speaker capable of producing high volume level sound such as a speakerphone, or a low audio speaker suited for producing low volume level sound. The mechanical housing 130 can be made of plastic or any other material capable of supporting the transducer 110.

The equal port configuration can include at least one front audio port 182 and at least one back audio port 184. The front audio port 182 and back audio port 184 can be a hole or vent for allowing a passage of air due to sound generated by the transducer 110. In one arrangement, the radio 101 can include a display 120 and a keypad 125 for providing a data communication aspect, though the radio 100 is not limited to these. A microphone 127 can be included on the front side. In a first arrangement, a user can operate the device in the frontal configuration of FIG. 1. That is, the display 120 and the keypad 125 can face the user. The user can type at the keypad 125 while simultaneously seeing text on the display. The frontal configuration 101 is suitable for data communications such as text messaging or gaming. In this arrangement the user can also hear audio emanating from the transducer 110, such as an audio clip, music, or voice from a second user, during data communication. Acoustic sound waves can propagate out of the radio 101 through the one or more front audio ports 182 and the one or more back audio ports 184 when audio is playing out of the transducer 110. The sound produced in this arrangement can be associated with a first sound quality. For instance, a perceptual evaluation sound quality (PESQ) system, as is known in the art, can be employed to rate the quality of sound produced in the frontal configuration from the user's perspective.

Figure 2:
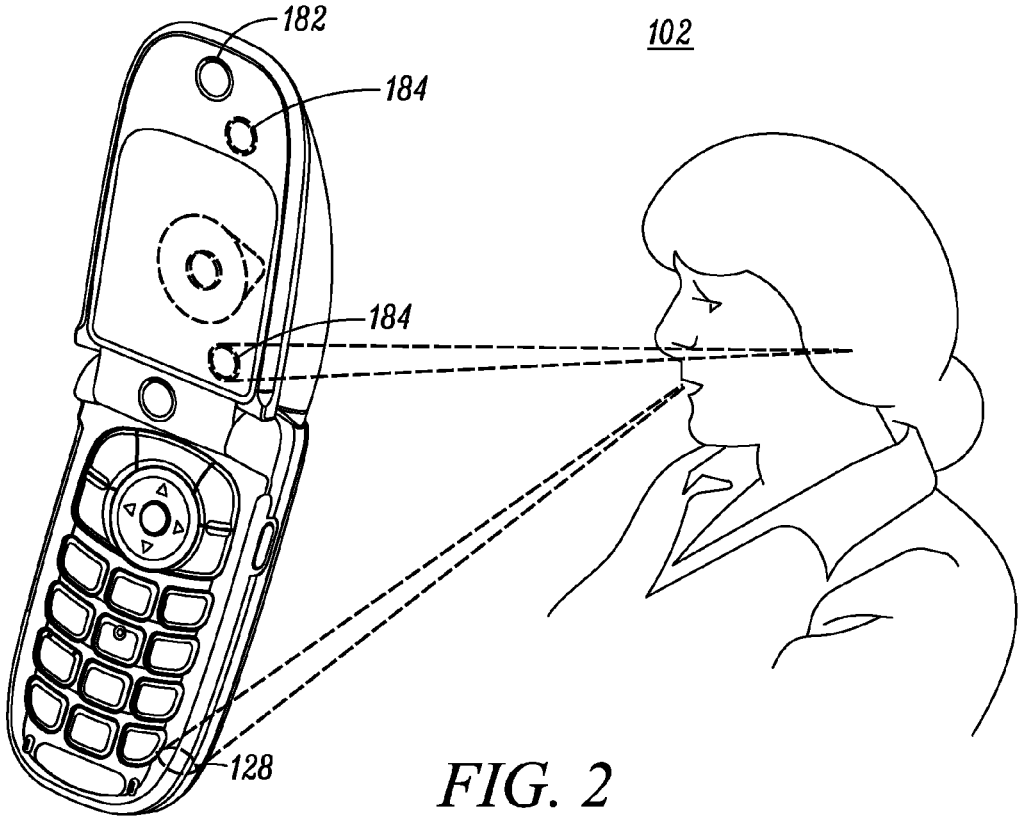
FIG. 2 is a back aspect of an audio device providing equal porting in accordance with an embodiment of the present invention.

Referring to FIG. 2, in a second arrangement 102, the user can turn the phone around, such that the front side is facing away from the user, and the back side is facing towards the user. In this arrangement 102, the user can use the radio 101 in an audio communication aspect. For example, the radio 101 can include a back microphone 128 that is on the back side of the radio for allowing dispatch communication. The microphone is not restricted to only the back side, and is shown in the exemplary arrangement only for illustration. A display or a keypad may also be on the back side. The user can talk into the microphone 128 and listen to audio from the radio 101. In this arrangement the user can hear sound emanating from the transducer 110, such as voice from a second user. When sound is playing out of the transducer 110, acoustic sound waves can propagate out of the radio 101 through the one or more front audio ports 182 and the one or more back audio ports 184. The sound produced in this arrangement can be associated with a second sound quality. For instance, a perceptual evaluation sound quality (PESQ) system, as is known in the art, can be employed to rate the quality of sound produced in the back configuration from the user's perspective.

One primary aspect of the invention, provides a first sound quality in the front arrangement 101 of FIG. 1 that is substantially the same as the second sound quality in the back arrangement 102 of FIG. 2. That is, from the user's perspective, the sound quality is consistent with regard to a frontal use of the radio or a reverse use of the radio. Notably, the sound quality in either the front or back arrangement is substantially similar as a result of the porting arrangement of the front audio ports 182 and the back audio ports 184. The similarity in the quality of the sound can be a measure of spectral distortion between a first sound projected from the at least one front audio port 182 and a second sound projected from the at least one back audio port 184. For example, the spectral weighting of a sound in either the front arrangement or the back arrangement is similar.

The quality of the sound can also be a measure of loudness between a first sound projected from the at least one front audio port 182 and a second sound projected from the at least one back audio port 184. That is, the loudness of a sound measured from the user's perspective in the front arrangement 101 is similar to a loudness of the back arrangement 102. A loudness analysis can be conducted for assessing the loudness of the sound, wherein the sound can be music, voice, or any other type of audio. The loudness analysis can assign a "sone" or "phon" rating to the sound, which are subjective measures of sound loudness. For example, the loudness of a voice playing through the speaker 110 will produce the same perceived volume level for both the front arrangement 101 of FIG. 1 and the back arrangement 102 of FIG. 2. It should be noted that loudness and volume level are not equivalent. Volume level is a function of Signal Pressure Level (SPL), whereas loudness is based on a sensitivity of human hearing that is frequency and level dependent. A volume level does not linearly correlate with a loudness level. The equal acoustic porting arrangement for providing equivalent loudness in either a front use mode or a back use mode is a result of a mechanical design that creates audio channels to the front audio ports 182 and back audio ports 184.

Figure 3:
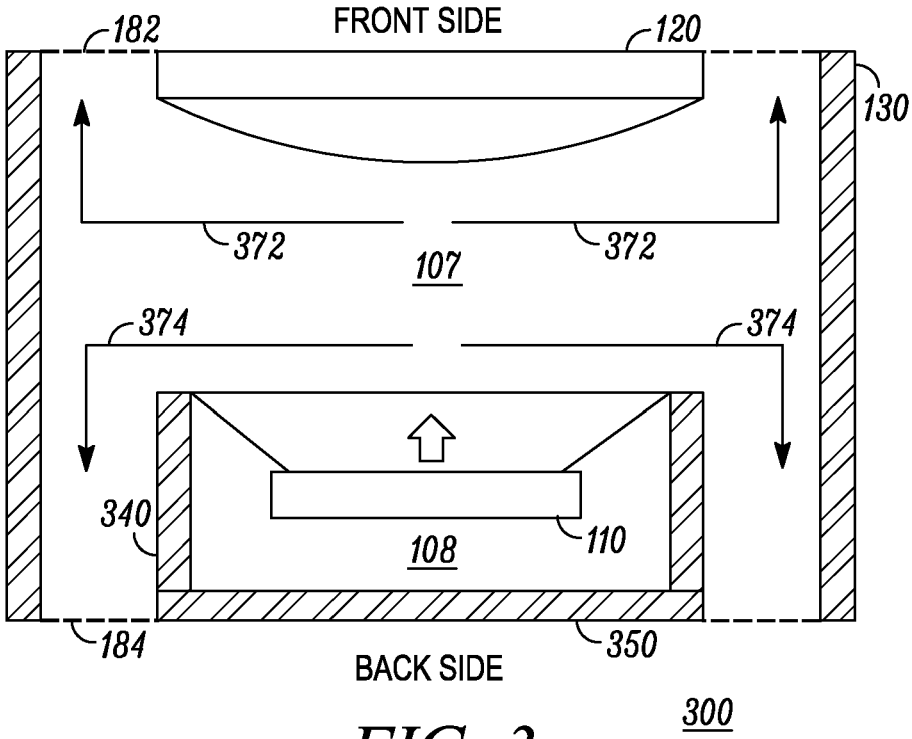
FIG. 3 is a cross section of an equal porting arrangement for a front and back side in accordance with an embodiment of the present invention.

Referring to FIG. 3, a cross section 300 of the radio 100 presented in FIG. 1 is shown. The cross section 300 reveals the equal audio porting design. The transducer 110 projects sound out of the at least one front audio port 182 and the at least one back audio port 184 such that a quality of the sound through the at least one front audio port and the at least one back audio port is substantially equal. The radio 100 can include a display 120 mounted to an interior of the front side wherein the at least one front audio port 182 is peripheral to the display 120. The display is not limited to the placement and position shown, and can reside anywhere along the front or back of the phone. The transducer 110 is positioned behind the display 120 such that sound projected from the transducer 110 in a direction of the display 120 and is channeled to the at least one front audio port 182 and the at least one back audio port 184. The front audio port 182 includes one or more vents, or holes, peripherally presented around the display 120. The back audio port 184 includes one or more vents, or holes, around a transducer enclosure 340. The radio 100 can also include a keyboard, or keypad, 125 (see FIG. 1) mounted to the front side wherein at least one front audio port 184 is peripheral to the keyboard 125. In this arrangement (not shown), the transducer 110 is positioned between the keypad and the display such that sound projected from the transducer 110 is channeled to the at least one front audio port 182 and the at least one back audio port 184. In another arrangement, the keypad 125 can be positioned where the display 120 is located; that is, the keypad 125 can be substituted for the display 120.

The transducer 110 is positioned within an enclosure 340 and pushes air through an interior passage way 107 (i.e. frontal volume). The passage way 107 consists of a front audio channel 372 and a back channel 374. The front audio channel 372 couples the front of the transducer 110 with the one or more front audio ports 182. The back audio channel 374 couples the front of the transducer 110 with the one or more back audio ports 184. In the configuration shown 300, the transducer 110 is facing towards the front section such that sound waves project in a direction of the display 120. The sound is then channeled by the front audio channel 372 and the back audio channel 374 out towards the ports 182 and 184.

The transducer 110 can also be mounted in a sealed enclosure on an interior of the back panel 350 such that air only escapes from the front of the transducer. That is, the transducer 110 can rest in the sealed back enclosure 340 and project sound towards the front side. Understandably, the sealed enclosure 340 suppresses acoustic back waves that may cancel with front acoustic waves emanating from the front of the transducer 110. The acoustic back waves generated behind the transducer 110 are confined to the interior space 108 of the enclosure 340. The sealed enclosure substantially suppresses this out-of-phase behavior which can unfavorably reduce the overall sound pressure level. The sealed back enclosure 340 also provides for a symmetric channeling of audio through the front audio ports 182 and the back audio ports 184. In one arrangement, the back of the sealed enclosure 340 can be the back panel 350. The interior of the enclosure corresponds to a back volume area 108.

The frontal volume area 107 supports a region of air which propagates as an acoustic wave toward the display 120 when the transducer 101 is active, i.e., playing audio. The frontal volume area 107 can be created by allowing a space between a transducer enclosure 340 and the display 120. The space produces an audio channel for porting sound away from the speaker 110 and towards an exterior of the radio 100 through one or more audio ports 182 and 184. Ports are generally drilled or cut through the plastic of the phone to allow air to flow through openings for passing sound. The ports are placed at locations which may be covered, or hidden, by various materials. For example, a speaker can be covered by a housing grill or a felt membrane for protecting the speaker from dust or dirt. In one mechanically artistic arrangement, holes can be created behind plastic strips of the housing grill such that an opening is created to allow air to flow from the speaker to the user. The ports can be positioned below the plastic strips of the housing grill such that a user cannot see the openings, i.e. the user only sees the housing grill which covers the openings, and not the hole openings below the plastic cross strips.

In the configuration shown 300, a volume area of the front audio channel 372 and a volume area of the back audio channel 372 are approximately the same. That is, the front audio channel 372 and the back audio channel 274 can pass an approximately equal volume of air produced by the transducer 110. The front audio channel 372 can also lead to one or more audio ports 182, and the back audio channel 374 can also lead to one or more back ports 184. The length of the front audio channel 372 and the length of the back audio channel 374 are also substantially the same. In the configuration shown, the area of the passage way for the front audio channel 372 and the back audio channel 374 is also symmetric. Understandably, acoustic sound waves are produced from the movement of a speaker cone which is part of the transducer 110. The sound pressure level (SPL) associated with the acoustic sound waves are a function of the force of the transducer pushing the speaker cone, the mass of the speaker cone, and a reactance of the transducer 110. The transducer converts electrical signals to acoustic pressure waves by moving the speaker cone in and out of a magnetic coil. The sound generated by the transducer 110 can be funneled through the front audio channel 372 and the back audio channel 374 out through the front audio port 182 and back audio port 184, respectively. The approximately equal volume area design of FIG. 3 produces sound from the front audio port 182 and back audio port 184 that is substantially the same. The equal audio porting design can be included in a cell phone, a personal digital assistant, a portable music player, a laptop display, or any other suitable communications device capable of sound production. For example, the device 100 may be a flip top for any of the aforementioned communication devices.

Figure 4:
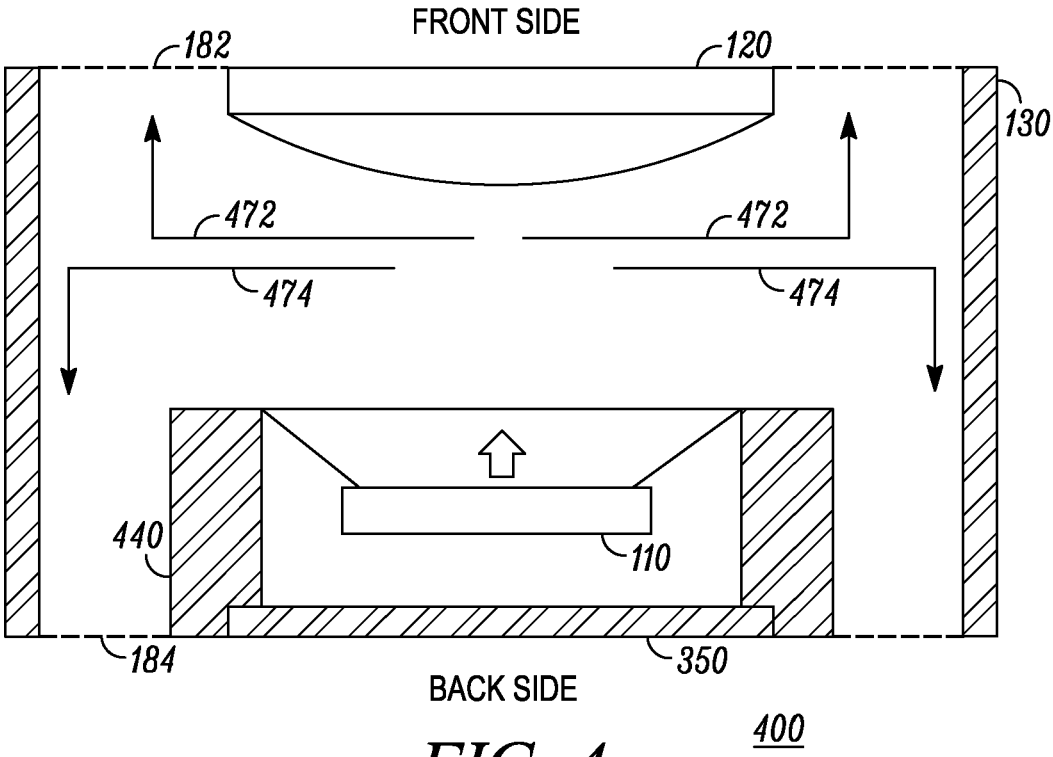
FIG. 4 is another cross section of a non-symmetric equal porting arrangement in accordance with an embodiment of the present invention.

The equal porting design of FIG. 3 is not restricted to the symmetrical arrangement of the front audio channel 380 and the back audio channel 384. For example, referring to FIG. 4, a non-symmetrical equal porting arrangement 400 is shown. Notably, the front audio ports 182 have a larger port opening than the back audio ports 184. For example, the width of the transducer enclosure 440 is larger than the width of the transducer enclosure 340 of FIG. 3. The larger width decreases the opening of the back audio ports 184. However, the length of the front audio channel 472 is shorter than the length of the back audio channel 474. Consequently, the overall volume, which is a product of length and area, of the front audio channel 472 and the back audio channel 474 are the same, thereby providing equal audio porting. In this arrangement, the quality of sound produced at the front audio ports 182 is substantially similar to the quality of sound produced at the back audio ports 184.

Figure 5:
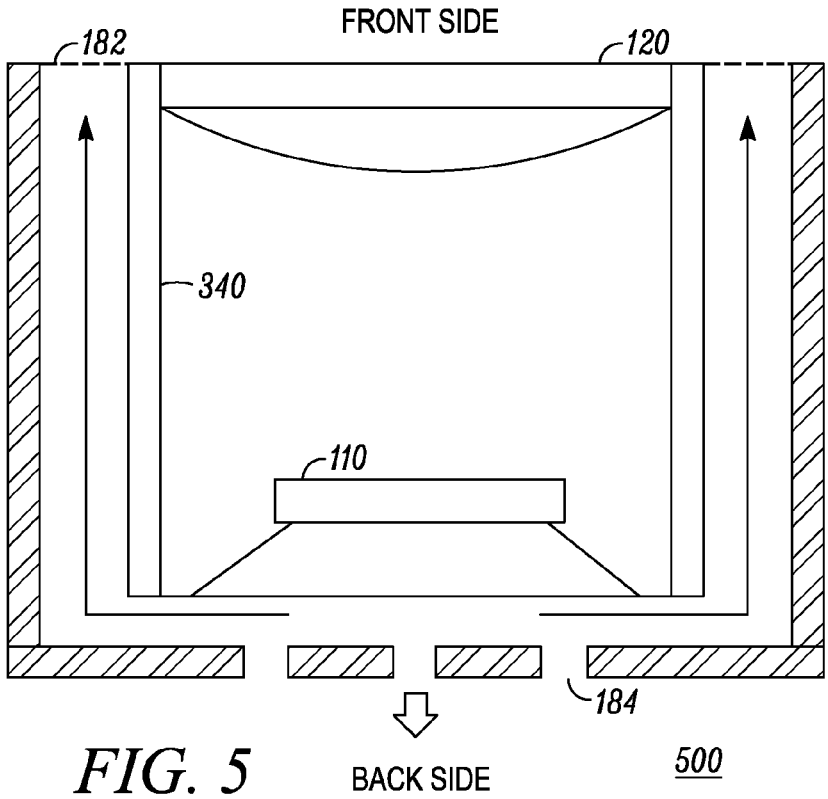
FIG. 5 is a cross section of an equal porting arrangement wherein an orientation of the transducer is reversed in accordance with an embodiment of the present invention.

In yet another configuration, the orientation of the transducer 110 can be reversed for providing yet another equal porting arrangement. That is, the speaker can be flipped 180 degrees for reversing the direction of sound propagation. Referring to FIG. 5, a cross section 500 of an equal porting arrangement wherein an orientation of the transducer is reversed is shown. The transducer 110 can project sound towards the back side which can be channeled by the front audio channels to the front audio ports 182 of the device. A sealed display enclosure 340 connects to an interior of the front side, wherein the transducer rests in the sealed display enclosure 340 and projects sound away from the display 120 and towards the back side. In this arrangement, the quality of sound produced at the front audio ports 182 is substantially similar to the quality of sound produced at the back audio ports 184.

Figure 6:
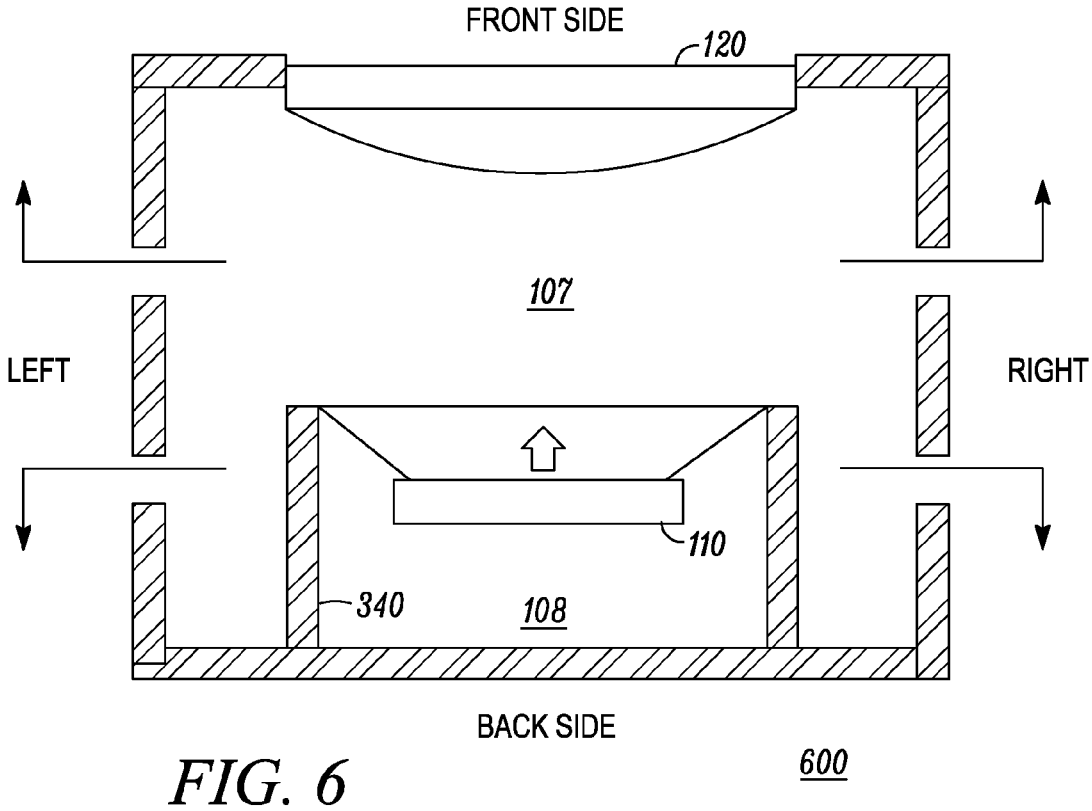
FIG. 6 is a cross section of an equal porting arrangement for a left and right side in accordance with an embodiment of the present invention.

Embodiments of the invention are also directed to an equal porting arrangement wherein a first audio port is to the left of a speaker enclosure and a second audio port is to the right of a speaker enclosure. Referring to FIG. 6, an equal porting arrangement 600 for a left and right audio porting is shown. In this arrangement, sound projected from the transducer is equally ported to the left and right side such that the subjective quality of sound is similar when measured at a front side of the device and a back side of a device. Again, briefly referring to FIG. 1, the user may use the radio 100 in a frontal configuration 101 or a reverse configuration 102. In either configuration, the sound emanating from the front or the back side, based on the left and right audio porting, sounds similar. Left and right equal audio porting is a practical porting arrangement when the radio 100 is in a belt-clip, carry holster, or the like. In these conditions, the front of the radio or the back of the radio are obscured. For example, in a belt-clip mode, the front of the device faces a body of the user. Understandably, audio quality would be degraded, or muffled, if the sound was projected from the front of the device. Accordingly, the equal porting configuration for the left and right side provide unobscured sound.

Figure 7:
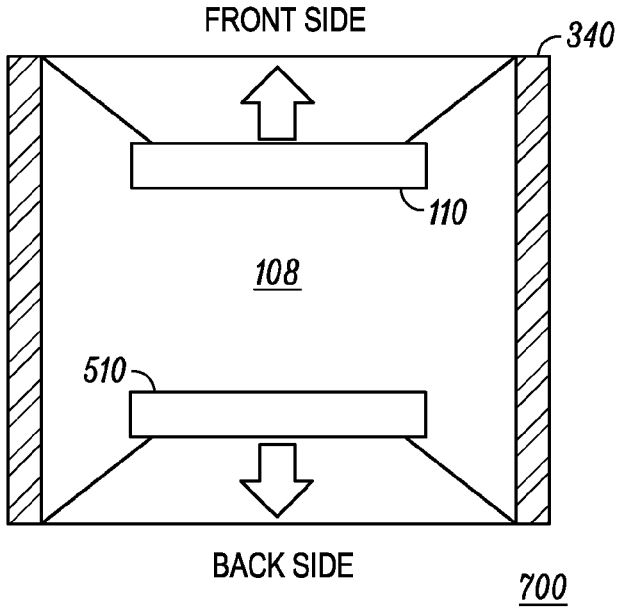
FIG. 7 is a cross section of a dual speaker equal porting arrangement in accordance with an embodiment of the present invention.

Embodiments of the invention are also directed to an equal audio porting arrangement wherein two transducers are employed to achieve substantially the same sound quality at either a front side or a back side. For example, referring to FIG. 7, a cross section 700 of an equal audio porting arrangement for a dual speaker device is shown. The dual speaker device can provide a front side having a first transducer 110, and a back side having a second transducer 510. The first transducer 110 projects sound directly forward and away from the radio 100, and the second transducer 510 projects sound directly back and away from the radio 100 in a direction approximately opposite to the first direction such that a sound quality from the front or the back of the radio is substantially the same. The dual speaker device can include an enclosure 340 coupling the first transducer 110 and the second transducer 510, wherein the enclosure 340 provides a back volume 108 that is common to a back side of the first transducer 110 and a back side of the second transducer 510. The front side can include a display and keypad (not shown) for presenting a data communication aspect. The back side can include a microphone (not shown) for presenting an audio communication aspect.

Figure 8:
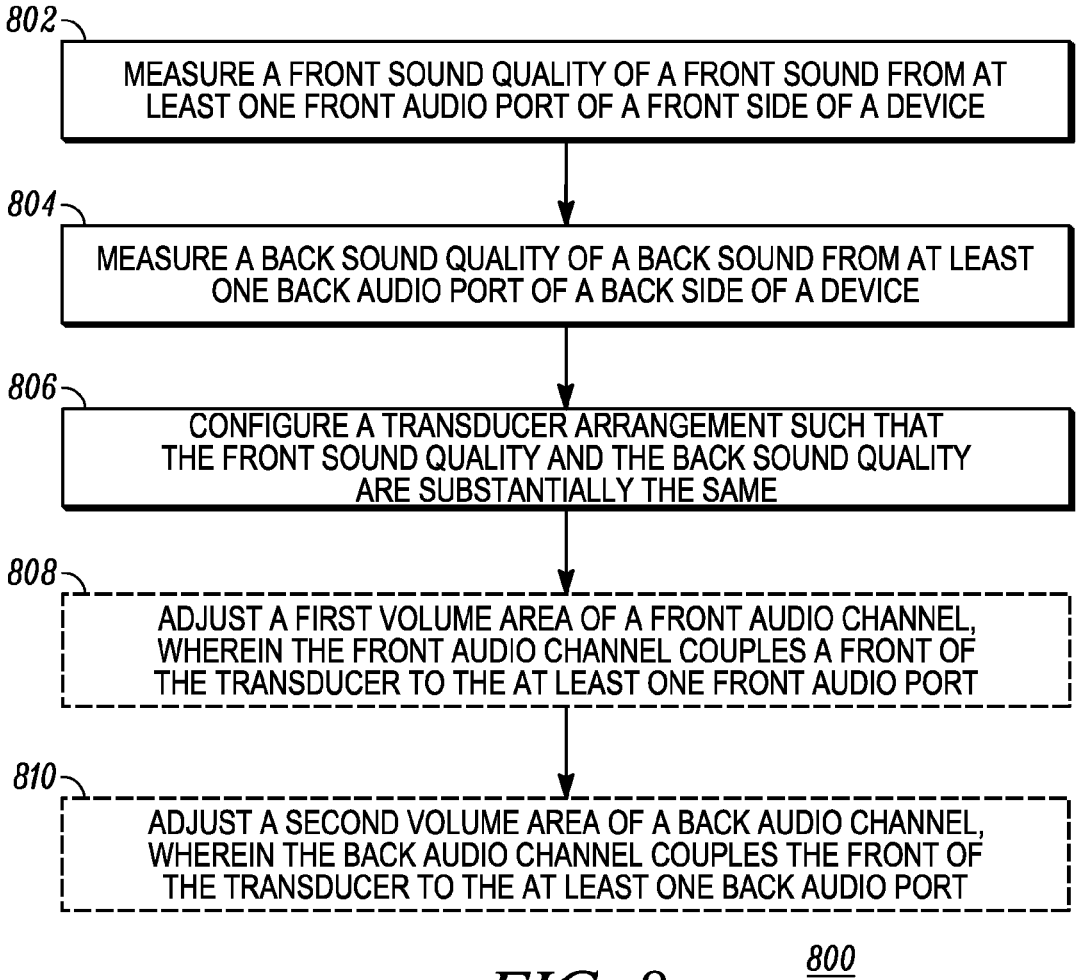
FIG. 8 is a method for designing a dual audio port in accordance with an embodiment of the present invention.

Referring to FIG. 8, a method 800 for designing an equal porting arrangement is shown. When describing the method 800, reference will be made to FIGS. 1 and 3, although it must be noted that the method 800 can be practiced in any other suitable system or device. Moreover, the steps of the method 800 are not limited to the particular order in which they are presented in FIG. 8. The inventive method can have a greater number of steps or a fewer number of steps than those shown in FIG. 8.

The method can begin in a state wherein a radio, such as that shown in FIG. 1 having a front audio port and an back audio port is prototyped for an equal porting arrangement. Understandably, during mechanical design, the prototype is tested to determine whether sound quality projected from the front of the device is substantially the same as the sound quality projected from the back of the device. At step 802, a front sound quality of a front sound can be measured from at least one front audio port of a front side of a device. For example, a Perceptual Evaluation Sound Quality (PESQ) system having a microphone can be employed to capture acoustic audio from a predetermined distance. The predetermined distance can correspond to the distance a user would hold the radio in a data communications mode. At step 804, a back sound quality of a back sound can be measured from at least one back audio port of a back side of the device. The same PESQ system can be used at a distance corresponding to the distance a user would hold the radio in audio communication mode.

Based on the front and back sound quality measurements, a porting arrangement is configured such that the front sound quality and the back sound quality are substantially the same. Understandably, the PESQ system produces a score for the front sound quality and the back sound quality. Designers can adjust aspects of the mechanical housing design, the porting arrangement, the transducer size, the transducer position, in order to achieve a score that is equal for both the front sound quality measurement and the back sound quality measurement.

For example, briefly referring to FIG. 3, the transducer 110 can be positioned between the front side and the back side for projecting the sound out of the at least one front audio port 182 and the at least one back audio port. 184. During configuration, a dimension of the one or more of the front audio channels or the back audio channels can be adjusted to achieve equal PESQ scores. For example, the volume area or length of an audio channel can be adjusted. Similarly, the opening of an audio port can be increased or decreased to adjust the sound quality.

The step 806 for configuring a transducer arrangement can include adjusting a first volume area of a front audio channel (808) and adjusting a second volume area of a back audio channel (810). As shown in FIG. 3, the front audio channel 372 couples a front of the transducer to the at least one front audio port 182, and the back audio channel 374 couples the front of the transducer to the at least one back audio port 184. At least one front audio channel and at least one back audio channel pass an approximately equal volume of air produced by the transducer 110.

Figure 9:
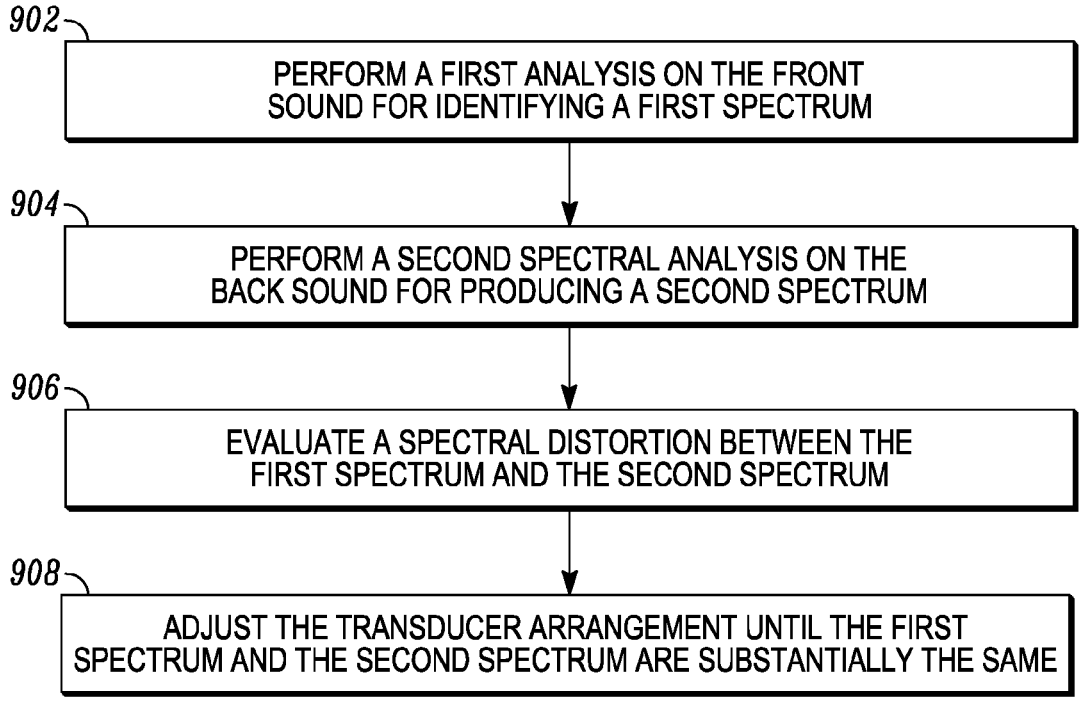
FIG. 9 is a method measuring a sound quality based on spectral distortion in accordance with an embodiment of the present invention.

Referring to FIG. 9, a method 900 for measuring a sound quality is shown. It must be noted that the method 900 can be practiced in any other suitable system or device. Moreover, the steps of the method 900 are not limited to the particular order in which they are presented in FIG. 9. The inventive method can have a greater number of steps or a fewer number of steps than those shown in FIG. 9. The method 900, employs a spectral analysis to assess a spectral shaping of sound from a front of the radio and a back of the radio. The method provides a measure of distortion for adjusting a porting arrangement to achieve similar spectral weighting.

At step 902, a first spectral analysis can be performed on a front sound for identifying a first spectrum. For example, a spectral analyzer can analyze a sound captured from an external microphone positioned at the front side of a radio. The microphone can be positioned at a location and distance corresponding to where a listener would hear the sound, for example, at a location corresponding to the listener's ear. The radio 100 can be tilted or positioned in an orientation that corresponds to a data communications aspect for evaluating the front sound quality. In one case, the spectral analyzer can capture a first time averaged spectrum of sound projected from the front of the device. At step 904, a second spectral analysis can be performed on the back sound for producing a second spectrum. For example, the spectral analyzer can analyze a sound captured from a microphone positioned at the back side of the radio 100 (See FIG. 1). The external microphone can be positioned at a location and distance corresponding to where a listener would hear the sound in an audio communications mode. The radio 100 can be tilted or positioned in an orientation that corresponds to a audio communications aspect for evaluating the back sound quality. In one case, the spectral analyzer can capture a second time averaged spectrum of sound projected from the front of the device. Notably, the front sound can also correspond to a first side, and the back sound can correspond to a second side, wherein the first side and the second side are opposite one another. For example, the method 900 can be practiced for providing equal porting to a left side and a right side of a device.

At step 906, a spectral distortion can be measured between the first spectrum and the second spectrum. For example, a first logarithm norm (L1) or a second logarithm norm (L2) can be applied to evaluate the difference in the first spectrum and the second spectrum. A norm can be defined as a standard, or normal metric, of measurement. The L1 and L2 norm are based on logarithms of the magnitude spectrum which can approximate human level sensitivity. Numerous spectral distortion measures are herein contemplated. At step 908, the porting arrangement can be adjusted until the first spectrum and the second spectrum are substantially the same. For example, a dimension of the one or more of the front audio channels 182 (See FIG. 3) or the back audio channels 184 can be adjusted to minimize spectral distortion, thereby achieving equal audio porting. For example, the volume area or length of an audio channel can be adjusted. Similarly, the opening of an audio port can be increased or decreased to adjust the sound quality.

Figure 10:
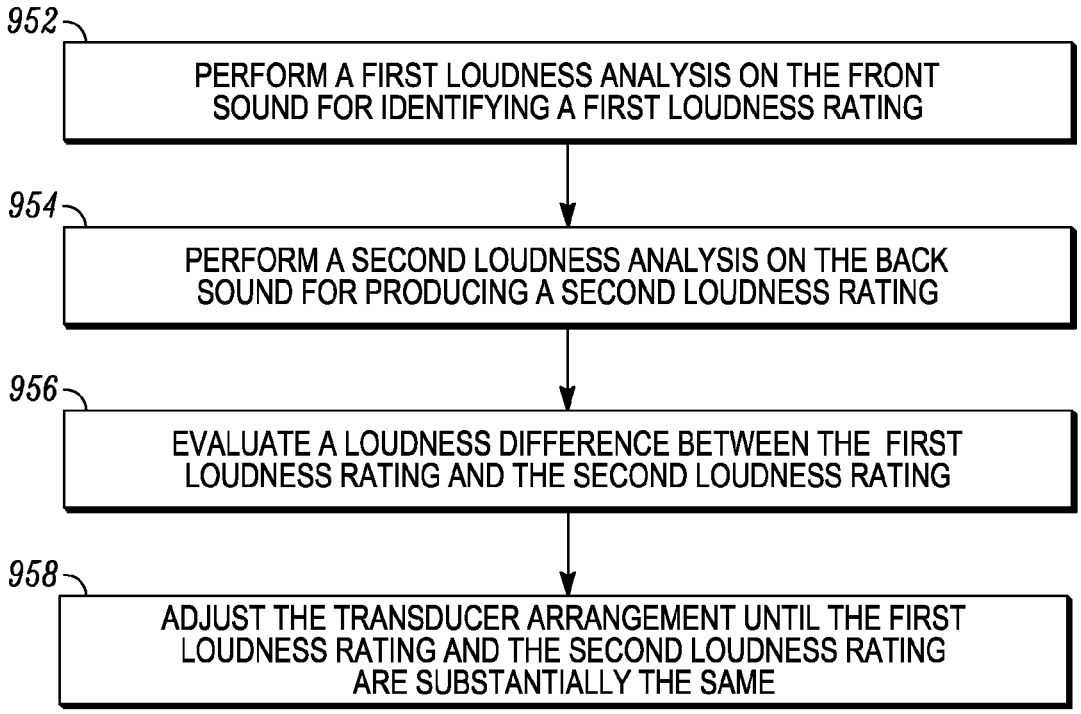
FIG. 10 is a method measuring a sound quality based on loudness in accordance with an embodiment of the present invention.

Referring to FIG. 10, another method 950 for measuring a sound quality is shown. It must be noted that the method 950 can be practiced in any other suitable system or device. Moreover, the steps of the method 950 are not limited to the particular order in which they are presented in FIG. 10. The inventive method can have a greater number of steps or a fewer number of steps than those shown in FIG. 10. The method 950, employs a loudness analysis to assess the loudness from a front of the radio and a back of the radio. The method 950 provides a measure of loudness for adjusting a porting arrangement to achieve equal loudness. The method 950 can be an extension of method 900 for including the steps of calculating a spectrum for assessing loudness. Notably, loudness approximates human sensitivity of hearing and is a function of spectrum, frequency, and compression.

At step 952, a first loudness analysis can be performed on the front sound for identifying a first loudness rating. As an example, a loudness analysis can be performed by a PESQ system, as is known in the art. The PESQ system can include a microphone that is positioned at a location and distance corresponding to where a listener would hear the sound. The radio 100 (See FIG. 1) can be tilted or positioned in an orientation that corresponds to a data communications aspect for evaluating the front sound quality. A loudness analysis can include calculating a linear frequency spectrum, applying a filterbank to transpose the frequency scale to a human hearing frequency scale, and applying a compressive non-linearity to the magnitude of the spectrum for creating a loudness spectrum. Signal energies within the filterbanks can be summed for providing a front critical loudness rating. The critical loudness rating is a subjective measure of perceived loudness.

At step 954, a second loudness analysis can be performed on the back sound for producing a second loudness rating. The loudness rating can be conducted in a manner similar to step 952. For example, the PESQ system can analyze a sound captured from a microphone positioned at the back side of the radio 100 (See FIG. 1). The microphone can be positioned at a location and distance corresponding to where a listener would hear the sound in an audio communications mode. The radio 100 can be tilted or positioned in an orientation that corresponds to an audio communications aspect for evaluating the loudness. The loudness analysis on the back sound can produce a back critical loudness rating.

At step 956, a loudness difference can be evaluated between the first loudness rating and the second loudness rating. A loudness difference can correspond to subtracting the front critical loudness rating from the back critical loudness rating. The units of measure can correspond to sones or phones. When the units are sones, the subtraction results in a measure of subjective loudness difference between the front data communications aspect and the back audio communications aspect. At step 958, a porting arrangement can be adjusted (See FIG. 3) until the front critical loudness rating and the front back loudness rating are substantially the same. That is, the loudness difference can be minimized to achieve an equal porting arrangement. For example, a dimension of the one or more of the front audio channels 182 (See FIG. 3) or the back audio channels 184 can be adjusted to minimize spectral distortion, thereby achieving equal audio porting. For example, the volume area or length of an audio channel can be adjusted. Similarly, the opening of an audio port can be increased or decreased to minimize the loudness difference. Notably, the front sound quality can also correspond to a first side, and the back sound quality can correspond to a second side, wherein the first side and the second side are opposite one another. For example, the method 950 can be practiced for providing equal porting to a left side and a right side of a device.

While the preferred embodiments of the invention have been illustrated and described, it will be clear that the embodiments of the invention is not so limited. Numerous modifications, changes, variations, substitutions and equivalents will occur to those skilled in the art without departing from the spirit and scope of the present embodiments of the invention as defined by the appended claims.

What is claimed is:

1. An equal audio port device, comprising:

a first side with at least one first audio port, wherein the first side presents a data communication aspect;

a second side with at least one second audio port, wherein the second side presents an audio communication aspect; and a transducer positioned between the first side and the second side, wherein the transducer projects sound out of the at least one first audio port and the at least one second audio port such that a quality of the sound through the at least one first audio port and the at least one second audio port is substantially the same;

wherein the first side of the device is a front side of the device, and the second side of the device is a back side of the device; and wherein the transducer is positioned between the front side and the back side for projecting sound out of a front audio port and a back audio port.

2. An equal audio port device, comprising:

a first side with at least one first audio port, wherein the first side presents a data communication aspect;

a second side with at least one second audio port, wherein the second side presents an audio communication aspect; and a transducer positioned between the first side and the second side, wherein the transducer projects sound out of the at least one first audio port and the at least one second audio port such that a quality of the sound through the at least one first audio port and the at least one second audio port is substantially the same, wherein a front of the transducer is facing a first side such that an acoustic sound wave projected from the transducer is equally channeled through the at least one first audio port and the at least one second audio port;

at least one first audio channel coupling the front of the transducer to the at least one first audio port;

at least one second audio channel coupling the front of the transducer to the at least one second audio port; and the at least one first audio channel and the at least one second audio channel passing an approximately equal volume area of air produced by the transducer; and a first length of the first audio channel being substantially equal to a second length of the second audio channel.

3. The equal audio port device of claim 2, wherein the quality of the sound is a measure of spectral distortion between a first sound projected from the at least one first audio port and a second sound projected from the at least one second audio port.

4. The equal audio port device of claim 2, wherein the quality of the sound is a measure of loudness between a first sound projected from the at least one first audio port and a second sound projected from the at least one second audio port.

5. The equal audio port device of claim 2, further comprising:

a sealed enclosure connected to an interior of the second side, wherein the transducer rests in the sealed second enclosure and projects sound towards a display on the first side.

6. The equal audio port device of claim 2, further comprising:

a sealed display enclosure connected to an interior of the first side, wherein the transducer rests in the sealed display enclosure and projects sound away from the display and towards the second side.

7. The equal audio port device of claim 5, wherein the first audio port is to a left of the sealed enclosure and the second audio port is to the right of the sealed enclosure, such that sound projected from the transducer is equally ported to the left and right side.

8. The equal audio port device of claim 5, further comprising:

a display mounted to the first side wherein the at least one first audio port is peripheral to the display, and the transducer is positioned behind the display such that sound projected from the transducer is channeled to the at least one first audio port and the at least one second audio port.

9. The equal audio port device of claim 6, further comprising:

a keyboard mounted to the first side wherein the at least one second audio port is peripheral to the keyboard, and the transducer is positioned between the keypad and the display such that sound projected from the transducer is channeled to the at least one first audio port and the at least one second audio port.

10. The equal audio port device of claim 2, wherein the equal audio port device is a flip panel for a cell-phone, a radio, a personal digital assistant, a portable music player, or a laptop display.

11. The equal audio port device of claim 2, wherein the first and second audio ports are facing opposite directions.

12. An equal audio port device, comprising:

a first side with at least one first audio port, wherein the first side presents a data communication aspect;

a second side with at least one second audio port, wherein the second side presents an audio communication aspect;

a transducer positioned between the first side and the second side, wherein the transducer projects sound out of the at least one first audio port and the at least one second audio port such that a quality of the sound through the at least one first audio port and the at least one second audio port is substantially the same;

wherein the first side of the device is a back side of the device, and the second side of the device is a front side of the device; and the transducer being positioned between the front side and the back side for projecting sound out of a front audio port and a back audio port.

* * * * *